United States Patent [19]

Thalenfeld et al.

[11] Patent Number: 4,805,861

[45] Date of Patent: Feb. 21, 1989

[54] LABEL HOLDER FOR MERCHANDISE DISPLAY HOOK

[75] Inventors: David R. Thalenfeld, Bear Creek; Joel I. Glickman, Huntingdon Valley, both of Pa.

[73] Assignee: Trion Industries Inc., Wilkes-Barre, Pa.

[21] Appl. No.: 48,659

[22] Filed: May 12, 1987

Related U.S. Application Data

[63] Continuation-in-part of Ser. No. 902,431, Aug. 29, 1986, Pat. No. 4,718,626.

[51] Int. Cl.[4] ..... A47F 5/00

[52] U.S. Cl. ..... 248/225.1; 248/221.3; 248/223.4; 211/57.1; 40/642

[58] Field of Search ..... 248/225.1, 223.4, 224.1, 248/224.2, 273.1, 221.3, 231.8, 223; 211/57.1, 59.1; 40/606, 10 R; 403/407.1, 406.1, 405.1

[56] References Cited

U.S. PATENT DOCUMENTS

| | | | |
|---|---|---|---|
| 1,558,154 | 10/1925 | Fetch | 248/231.8 |
| 3,350,047 | 10/1967 | Anderson | 248/464 |
| 3,696,916 | 10/1972 | Penniman et al. | 248/127 X |
| 3,734,439 | 5/1973 | Wintz | 248/224.1 |
| 3,881,677 | 5/1975 | Ihlenfeld | 248/224.1 |
| 3,928,894 | 12/1975 | Bury et al. | 248/223.4 X |
| 4,319,731 | 3/1982 | Pfiefer | 248/223.4 |
| 4,405,051 | 9/1983 | Thafenfeld | 211/57.1 |
| 4,517,880 | 5/1985 | Buckner et al. | 248/27.3 X |
| 4,524,941 | 6/1985 | Wood et al. | 248/221.3 X |
| 4,550,230 | 10/1985 | Johnson | 248/27.3 X |
| 4,718,626 | 1/1988 | Thalenfeld et al. | 248/223.4 X |

FOREIGN PATENT DOCUMENTS

| | | | |
|---|---|---|---|
| 20584 | 9/1904 | United Kingdom | 248/223.1 |
| 2149013 | 6/1985 | United Kingdom | 248/223.4 |

*Primary Examiner*—Alvin C. Chin-Shue

*Attorney, Agent, or Firm*—Schweitzer & Cornman

[57] ABSTRACT

A merchandise display hook is provided at its outer end with a metal plate for mounting a plastic label holder of desired shape and size. The label holder is uniquely designed to provide a variety of advantageous functional features, while, at the same time, being capable of high speed, high precision, automated molding processes, so as to be marketable at extremely low cost. The label holder can be easily and positively mounted on a metal plate and is arranged to receive and effectively retain in position an information label containing pricing information, bar code, etc.

3 Claims, 5 Drawing Sheets

LABEL HOLDER FOR MERCHANDISE DISPLAY HOOK

RELATED APPLICATIONS

This application is a continuation-in-part of application Ser. No. 902,431, filed Aug. 29, 1986 now U.S. Pat. No. 4,718,626, granted Jan. 12, 1988.

BACKGROUND AND SUMMARY OF THE INVENTION

Merchandise display hooks are utilized in a wide variety of sizes, shapes and designs for the display of carded merchandise and the like. Typically, such mechandise display hooks are formed of wire, and are designed to include one or more outwardly extending wire arms for the support of merchandise and/or information. At the back of the hook, there is typically mounted a base plate or base member, by which the hook may be mounted for display. Most typically, the base member is provided with a pair of L-shaped lugs, engageable with a pair of openings in an apertures panel board.

To a substantial and continually increasing extent, display mechandisers are setting up point-of-purchase displays with merchandise display hooks that utilize, in conjunction with the product display, an information label. The information label contains such data as price, product description, unit pricing, and bar code information for automatic readout of all of the foregoing, as well as for inventory control. Especially because of the desire for automating the task of inventoring display products, the presence of a label containing bar code information is becoming increasingly important. As a result, it is becoming more common for merchandise display hooks to incorporate a first wire-like arm for the support and display of merchandise, and a second wire-like arm, extending above the first, for support of an information display label. Particularly advantageous, earlier forms of merchandise display hooks for this purpose are shown in prior U.S. Pat. Nos. 4,351,440, 4,405,051 and 4,474,351, issued to Trion Industries, Inc., Wilkes-Barre, Pa. The present invention is directed to merchandise display hooks of the general type reflected in these earlier patents, but incorporating features of improvement, particularly with respect to the mounting of a label support on the wire-like arm and with respect to the mounting and retention of an information label on such label support.

In the display hook of the beforementioned U.S. Pat. No. 4,405,051, a label support arm is provided at its outer extremity with a rectangular metal plate, preferably secured by welding. The metal plate is of a standard size and configuration for all styles and sizes of hooks. The label holder itself is a plastic device for extruded construction, having continuous horizontal flanges at the rear, which are slideable laterally over the rectangular mounting plate. In the prior device, the plastic label holders are extruded in continuous form, to accommodate low cost manufacture, and are later cut to predetermined length, for customization to the needs and desires of individual users. The display hook of the '051 patent has been extremely successful commercially. Nevertheless, we have observed opportunity for still further improvement, particularly in the area of label positioning, ease of assembly and in the esthetics of the device itself as well as of a complete display utilizing the devices.

In the marketing of a two-part display hook, such as shown in the beforementioned '051 patent, it is customary to ship the two parts in disassembled condition, with the final assembly being performed by store personnel. This enables the store management to determine the desired size and shape of label holder, for example, for a particular display. One of the disadvantages of this procedure, however, is that the store personnel may be somewhat careless in centering the extruded label holders on the metal mounting plates, which can detract from the visual appearance of the overal display. Additionally, the label holders are subject to subsequent lateral movement on their mounting plates, either by customers or store personnel, even though they are mounted rather tightly on the metal plates. This too can make a merchandise display look less neat and orderly than would be desired.

In our patent application Ser. No. 902,431, the disclosure of which is hereby incorporated by reference, there is disclosed an improved form of injection molded plastic label holding plate, which incorporates significantly improved features for mounting of the label holder on the metal plate of the display device. Molded plastic label holding plates are, of course, not new in a broad sense, an example of a known form of molded label holder being disclosed in the beforementioned U.S. Pat. No. 4,351,440. Nevertheless, the use of such molded label holding plates has not heretofore been commercially successful because of what was thought to be the inherently higher cost of the molded device of functionally equivalent characteristics. In accordance with the present invention, the molded plastic label holder is so designed and constructed that it can be mass produced on high speed, automatic injection molding machinery, such that its cost is entirely competitive with label holders of extruded construction. The new label holder is, however, functionally greatly superior to the extruded item, partly because of the facility with which the new molded label holder may be mounted on the hook, and the positive manner in which the label holder is positioned, and also because of the facility with which information display labels may be mounted on and removed from the new label holder.

The label holder of the invention includes spaced, vertically disposed mounting flanges, centered along the back face, which are open at the bottom for vertically downward application of the holder over a flat metal mounting plate at the end of the display wire. Abutment means at the upper edge of the label holder limit the downward movement thereof and position the label holder properly on the metal mounting plate. A resiliently deflectable locking element, which is displaced during the initial application of the label holder over the mounting plate, assumes its normal position when the parts are fully assembled and serves to lock the label holder in position on the mounting plate. This locking element is accessible only from the rear of the label holder, when a label is in position thereon, and is normally concealed by the presence of the label to effectively prevent unauthorized removal of the label holder.

In accordance with another feature of the invention, discontinuous label-retaining flanges of a novel design and construction are provided on the front face of the label holder, certain ones along the bottom edge and others along the top edge, for retention of an information label at the front surface of the plate. Advantageously, the label holding plate is provided with horizontal through openings opposite each of the label mounting flanges. Likewise, the label holding plate is provided with vertical through openings opposite to and coextensive with the flanges provided for engagement with the vertical edges of the metal mounting plate. These various openings accommodate the presence of mold elements, such that the plate may be produced by high speed, precision injection molding processes with molds of economical design. At the same time, the several openings formed in the label holding plate do not compromise the performance of the device.

For a more complete understanding of the above and other features and advantages of the invention, reference should be made to the following detailed description of a preferred embodiment, and to the accompanying drawing.

DESCRIPTION OF A PREFERRED EMBODIMENT OF THE INVENTION

Figure 1:
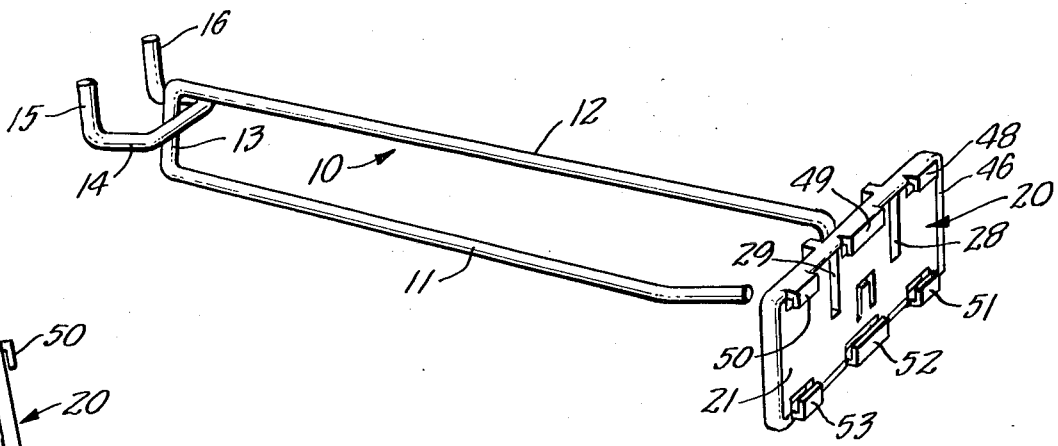
FIG. 1 is a perspective illustration of a form of merchandise display hook having upper and lower wire arms for, respectively, the support of an information label and the support of merchandise, with a label holding plate according to the invention being mounted at the other end of the upper arm.

Referring now to the drawings, and initially to FIG. 1 thereof, the reference numeral 10 designates in a general way a merchandise display hook adapted for mounting on an apertured display panel. The hook 10 is formed of wire and includes a lower, merchandise supporting arm 11 and, integral therewith, an upper label supporting arm 12. In the illustrated arrangement, the two arms 11, 12 are connected by a short vertical section 13. A U-shaped section 14 of similar wire is rigidly welded to the vertical section 13 and is provided with upstanding, L-shaped lug portions 15, 16 of a size and spacing to be received in adjacent openings in a conventional apertured panel.

At its outer end, the upper wire 12 is formed with a short downward extension 17 to which is welded a rectangular metal plate 18. The plate 18 is desirably formed with an arcuate saddle 19 which is positioned on the downward extension 17 of the wire upper arm 12 and secured thereto by welding. The welding process allows the rectangular plate 18 to be rather precisely aligned with the axis of the upper wire arm 12, notwithstanding possible imperfections in the precision of the bending operation that forms the downward extension 17.

Figure 2:
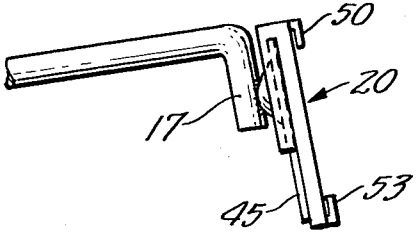
FIG. 2 is a fragmentary side elevational view of the display hook of FIG. 1, illustrating the manner of mounting the label holding plate at the outer end of the display arm.

As reflected in FIGS. 1 and 2, the label holding plate 20, to be more fully described, is mounted on the rectangular metal plate 18 and is oriented to be substantially symmetrical with and at right angles to the axis of the upper arm 12. The label holding plate 20 is of molded plastic construction, designed according to the invention for high speed, high precision, highly automated molding procedures. That is, the features of the invention provide for the functionally superior label holding plate, which is at the same time capable of production by high speed, fully automated precision molding practices, so as to be highly cost competitive with more conventional, extruded plates, which are functionally inferior.

Figure 12:
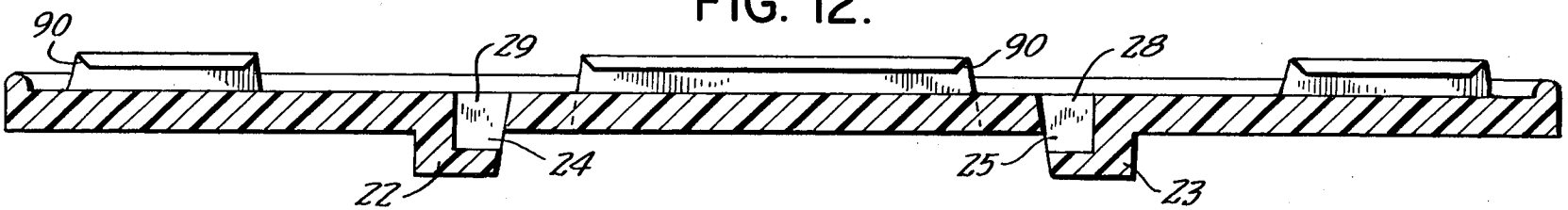

With reference to the drawing, the label holding plate include a flat, rectangular panel section 21 which is relatively thin (e.g., 0.060") in relation to its overall height and width, and is generally flat on its front and back principal surfaces. For mounting on the rectangular metal plate 18, the label holding plate 20 is provided on its back surface with a pair of vertically oriented mounting flanges 22, 23. The flanges 22, 23 are of generally L-shaped cross section, as shown in FIGS. 12 and 13. These flanges define respective channels 24, 25 for the reception of edge margins of the rectangular mounting plate 18. The channels 24, 25 are open at the bottom but are closed at the top, by means of upper abutment surfaces 26, 27 (FIG. 13).

Pursuant to the invention, elongated vertical openings 28, 29 are formed in the flat planel section 21. These openings enable the flanges 22, 23 to be formed in part by mold elements projecting through from the front of the panel section. With reference to FIG. 17, for example, the reference numerals 30, 31 represent generally upper and lower mold halves, each consisting of a center section 32, 33 and opposite end sections 34, 35 and 36, 37. The cross section of FIG. 17 is taken as generally along the same line as that of FIG. 12 and illustrates a section through the mold cavity, shown filled with plastic material. The lower central mold section 33 has a pair of channels 38, 39 formed therein provided with inner walls 40 which are disposed at a slight angle (e.g., 10°) toward the center axis of the mold section. The upper half 32 of the center section includes a pair of projecting ribs 41, 42, each provided with angularly disposed inner walls 43 which are complementary with the inner walls 40 of the recesses 38, 39. When the two mold sections 32, 33 are brought together with the desired spacing between them corresponding to the thickness of the center panel 21, the respective angled surfaces 40, 43 contact each other in sealing relation, so that the flange-forming cavities are defined in an L-shaped configuration. The long dimension of the mold ribs 41, 42 is such that the "upper" end of the ribs terminates slightly inside the upper edge of the plate 20, and slighlty inside the "upper" extremity of the recesses 38, 39. This forms a cavity at the upper ends of the recesses 38, 39 which form the end abutments 26, 27 shown in FIG. 13.

At their opposite ends, the ribs 41, 42 are coextensive in length with the recesses 38, 39 and are provided with mutually tapered end surfaces (not shown) corresponding generally to the sidewall surfaces 40, 43, serving to seal the inner end portions of the cavity thus providing for open ended slots 24, 25 to be formed.

Figure 4:
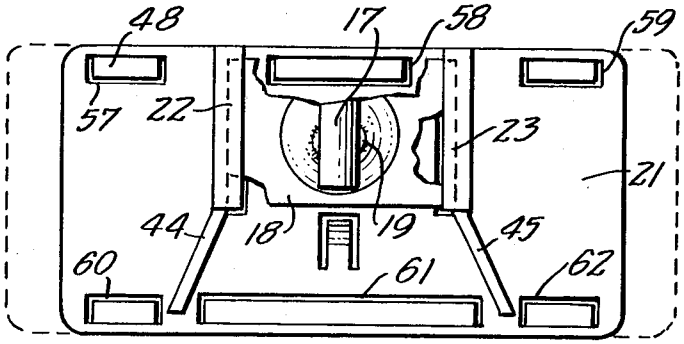
Figure 9:
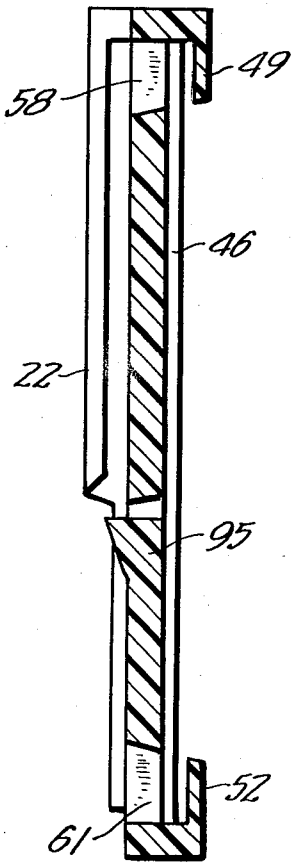
FIGS. 6–9 are vertical cross sectional view taken generally along the lines 6—6 through 9—9 respectively of FIG. 3.
Figure 8:
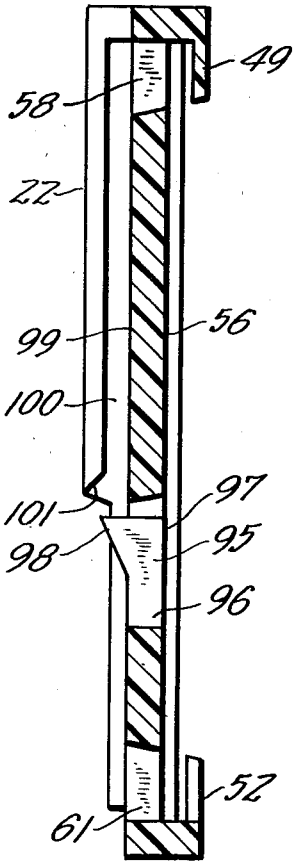
Figure 7:
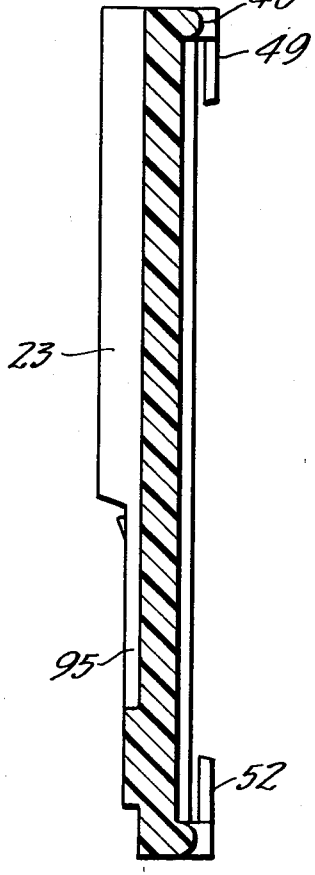
Figure 6:
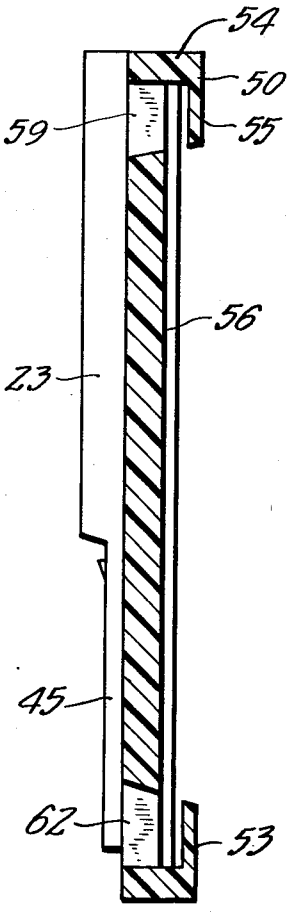
Figure 5:
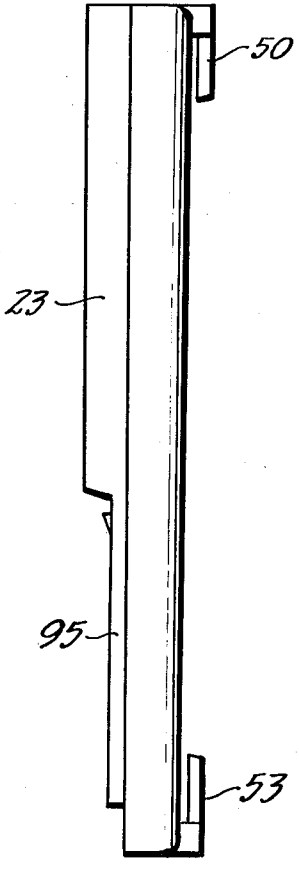
FIG. 5 is an end elevational view of the label holding plate of FIGS. 3 and 4.
Figure 12A:
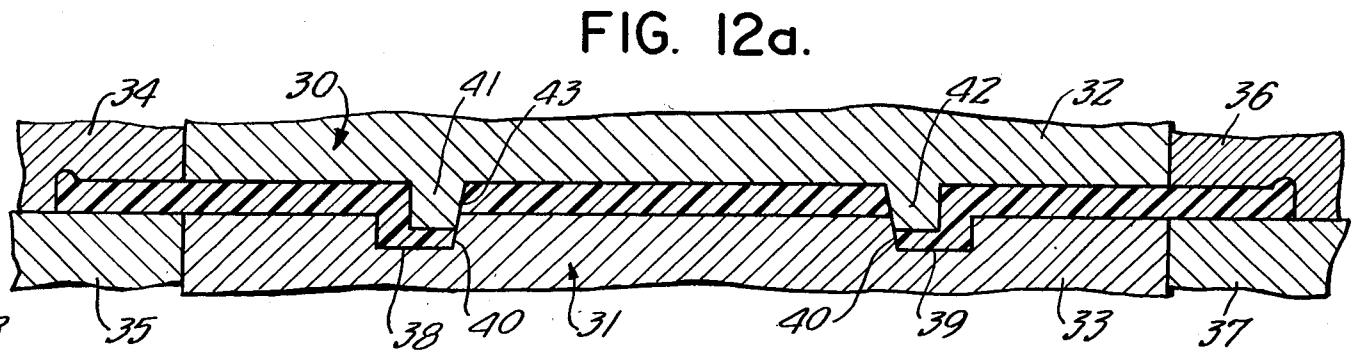
FIG. 12*a* is a cross sectional veiw as taken through assembled mold halves of FIGS. 14, 15 as at a location similar to the section line 12—12 of FIG. 3.

The lower mold section 33 is also provided with recesses 63, 64 to form divergently related guide ribs 44, 45 which join integrally with the lower ends of the mounting flanges 22, 23 (see FIG. 4) and project a short distance rearward of the back surface of the panel section 21. The guide flanges 44, 45 assist in guiding the label holder plate 20 onto the metal mounting plate 18. The label holder plate merely has to be pressed against the metal plate 18 and then urged downwardly. If the label holder is not properly aligned, the edges of the metal plate will be engaged by one or the other of the guide flanges 44, 45 to assist its entry into the area of the mounting flanges 22, 23.

In the illustrated form of the invention, it is contemplated that the label holder plate may be made in various lengths, to accommodate custom sizing of the holder to various label sizes. To this end, the opposite end mold sections 34, 35 and 36, 37 are interchangeable to provide end sections in different sizes. As shown in FIG. 19, a mold housing 46 contains a master recess 47 in which are received the three mold parts, these being, in the illustration, the lower mold parts 33, 35 and 37. The center mold parts 32, 33 are utilized for all sizes. The end sections 35, 37 and 34, 36 may, however, be changed to define cavities of different total length.

In the parent application Ser. No. 902,431, the form of the invention therein specifically illustrated was intended to support self-adhering labels. The form of the invention specifically illustrated herein is, by contrast, designed to accommodate slide-in labels. In order to accommodate slide-in labels, the new label holder is provided along its upper and lower edge margins with upper and lower retaining flanges 48–50 and 51–53, each set of flanges forming, in effect, a discontinuous flange for retention of the upper and lower label margins.

Figure 9A:
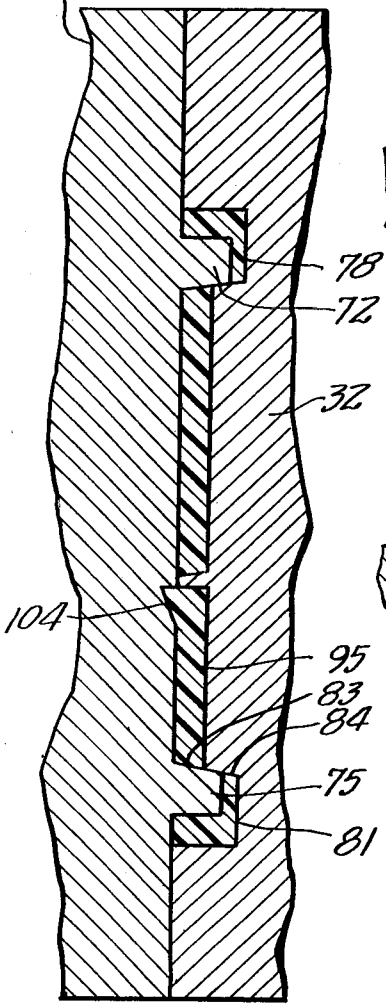
FIG. 9*a* is a cross sectional view through an assembled pair of mold halves, filled with plastic material, taken as at a location similar to the location of line 9—9 of FIG. 3.
Figure 10:
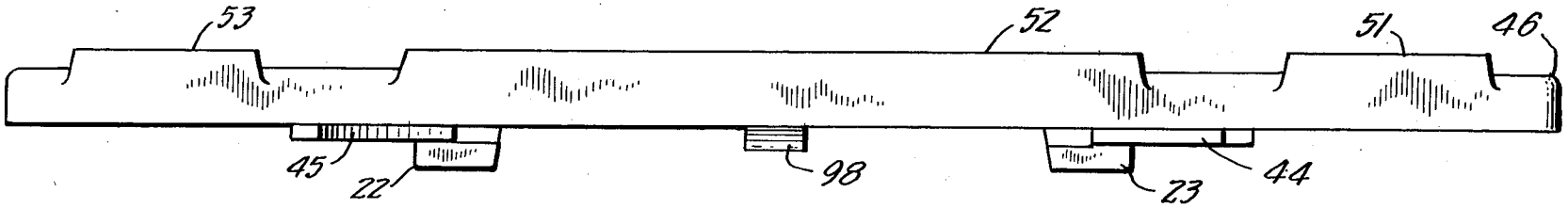
FIG. 10 is a bottom view of the label holder plate of FIG. 3.
Figure 11:
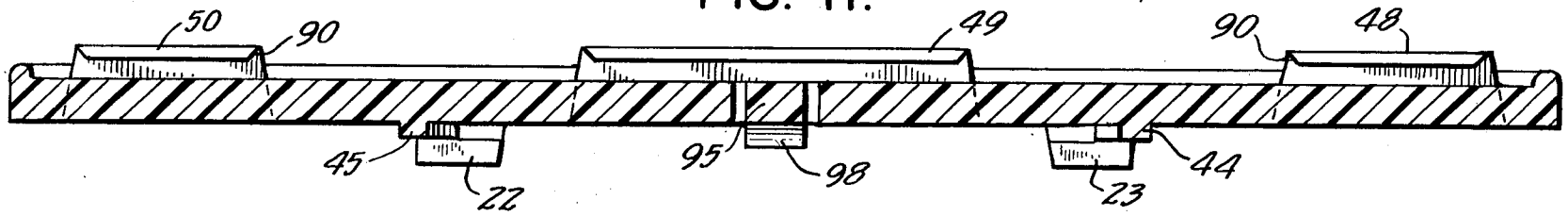
FIGS. 11–13 are horizontal sectional views as taken generally on lines 11—11 through 13—13 respectively of FIG. 3.

As reflected in FIGS. 5–9, for example, the flanges 48–53 are of generally L-shaped configuration, each having a forwardly projecting portion 54 (FIG. 6) and an inwardly projecting portion 55 spaced outward from the front surface 56 of the label holder plate a distance sufficient to accommodate the presence of a typical label (not shown), formed of paper board or plastic material, for example. Opposite each of the flanges 48–53 is a through opening 65–70 in the panel section 21, formed cooperatively by series of mold ribs 71–76, projecting from the lower mold sections 31, 35, 37, and complementary recesses 77–82 in the upper mold sections 32, 34, 36. As reflected in FIG. 9*a*, the various mold ribs 71, 75 cooperate with the respective recesses 71, 76, 77, 82 to form cavities of L-shaped cross section, with respective inner walls 83, 84 of the ribs and recesses being disposed at a slight angle (e.g., 10°) and being in sealing contact when the mold parts are closed, providing in the finished product a lateral opening to accommodate a presence of the label edge margin under the retaining flanges. In a similar manner, the opposite end walls of the various mold ribs 71–76, as indicated at 85, 86 in FIG. 15, for example, are slightly tapered and cooperate with corresponding tapered end walls of the mold recesses 77–82, so that the ends of the cavities are sealed off to provide for open end access to the flanges 48–53.

As is evident in the drawings, the several upper flanges 48–50 are separate but aligned, forming in effect a discontinuous flange along the upper edge of the label holder. The lower flange sections 60–62 likewise are separate and aligned, forming in effect a discontinuous flange along the lower edge. This discontinuous flange structure provides entirely adequate support for the retained label element, but at the same time assures that the overall label holder structure will have adequate strength, bearing in mind the presence of the through openings 65–70 opposite the respective flange sections 48–53. To advantage, the vertical, mounting plate retaining flanges 22, 23 extend into the space between the upper flanges 48, 49 and 49, 50 while the lower guide ribs 44, 45 extend downward into the space between the discontinuous lower flange sections 51–53.

Desirably, the edge bead 46 is provided about the entire periphery of the label holder plate, except, of course, those areas where the flanges 48–53 are located. The portions of the bead 46 along the opposite end edges of the label holder serve an important function of retention of the label against endwise movement, once the label is mounted in place with its edge margins under the flange sections 48–53.

Figure 3:
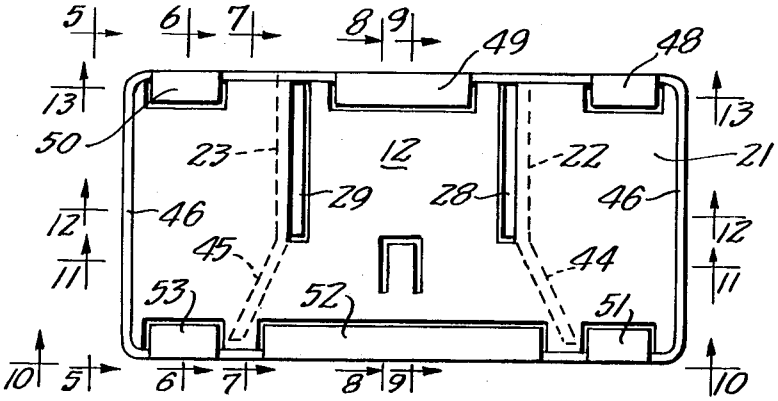
FIGS. 3 and 4 are front and back elevational views respectively of the molded plastic label holding plate of the invention.
Figure 13A:
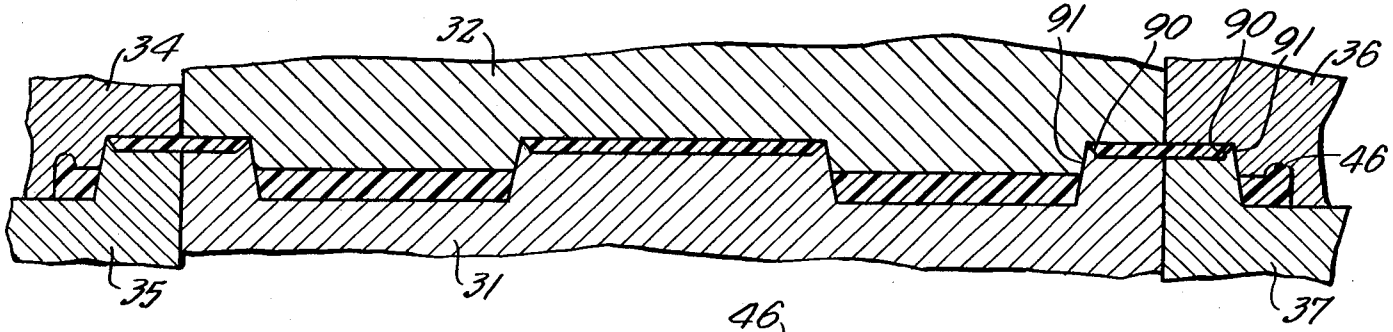
FIG. 13*a* is a cross sectional view of assembled mold halves, similar to FIG. 17, taken as along a section line located similarly to line 13—13 of FIG. 3.
Figure 13:
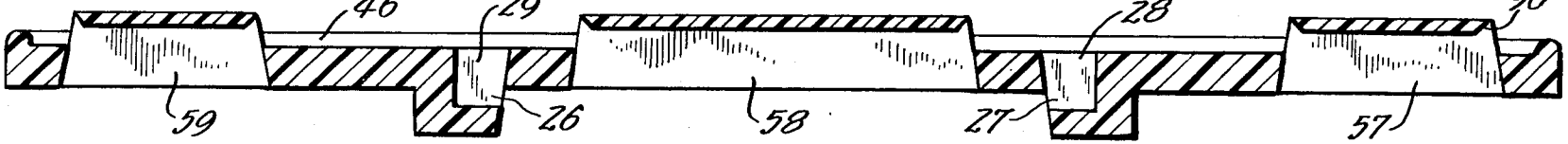

To facilitate endwise sliding insertion of a label onto the label holder plate, it is especially desirable to provide for bevelled end surfaces 90 at each end edge of the flange outer walls (see FIG. 13*a*). Such bevelled end surfaces are provided by forming the respective mold ribs 71–76 (FIG. 15) to have upwardly and outwardly divergent end surface areas 91. As may be visualized in FIG. 14, as a label of a size and shape appropriate for the label holder is inserted endwise under the flanges, it tends to be guided underneath the flange, rather than to be caught up on the leading edge of the flange, as the label is advanced endwise into a fully inserted position. Typically and desirably, the clearance space between the front surface 56 of the label holder and the under surfaces of the flanges 48–53 may be approximately 0.030", adequate to receive a typical label but without a great deal of extra space. The height of the edge ribs 46 desirably is approximately equal to the clearance space between the label holder surface and the underside of the flanges, such that the label is required to be substantially deflected, in order to be removed from its installed position. As reflected in FIG. 3, for example, the edge-most sets of flanges terminate quite close to the end edge portion of the bead 46, for example, 0.075"

inward thereform, such that an installed label is quite securely retained against accidental dislodgement.

As described in the beforementioned parent application Ser. No. 902,431, a deflectable locking tab 95 is molded intergrally with the panel section 21, secured in cantilever fashion at its root end 96 and being free on three sides for flexing movement in a direction normal to the plane of the label holder. The front surface 97 of the locking tongue is generally flush with the front surface 56 of the label holder, while the back surface of the locking tongue has a rearwardly projecting inclined surface 98 projecting a substantial distance beyond the back surface 99 of the label holder plate. As reflected in FIG. 8, the mounting flanges 22, 23 define a clearance channel 100 for the reception of the side edges of the mounting plate. The width of this clearance channel may be on the order of 0.030". The locking tongue 98 advantageously projects rearwardly approximately the same amount. The arrangement is such that, when the backing plate is inserted into the clearance space 100, the tongue 95 must first be deflected forwardly sufficiently to enable the backing plate to clear. To facilitate this insertion, the flanges 22 are provided at their lower extremities with bevelled surfaces 101 (FIG. 8) formed by angular projections 102 on the mold ribs 41, 42. The locking tongue 95 is formed in the molding process by a U-shaped projection 103 provided on the upper mold half, in conjunction with a wedge-shaped recess 104 in the lower mold half 31.

Figure 16:
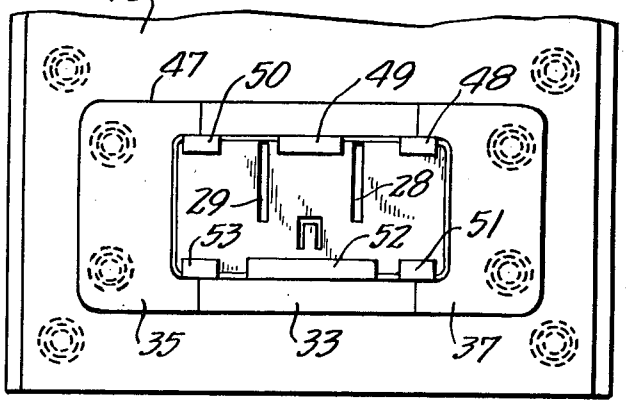
FIG. 16 is a simplified illustration of a mold form, provided with a recess for the reception of the mold halves.
Figure 14:
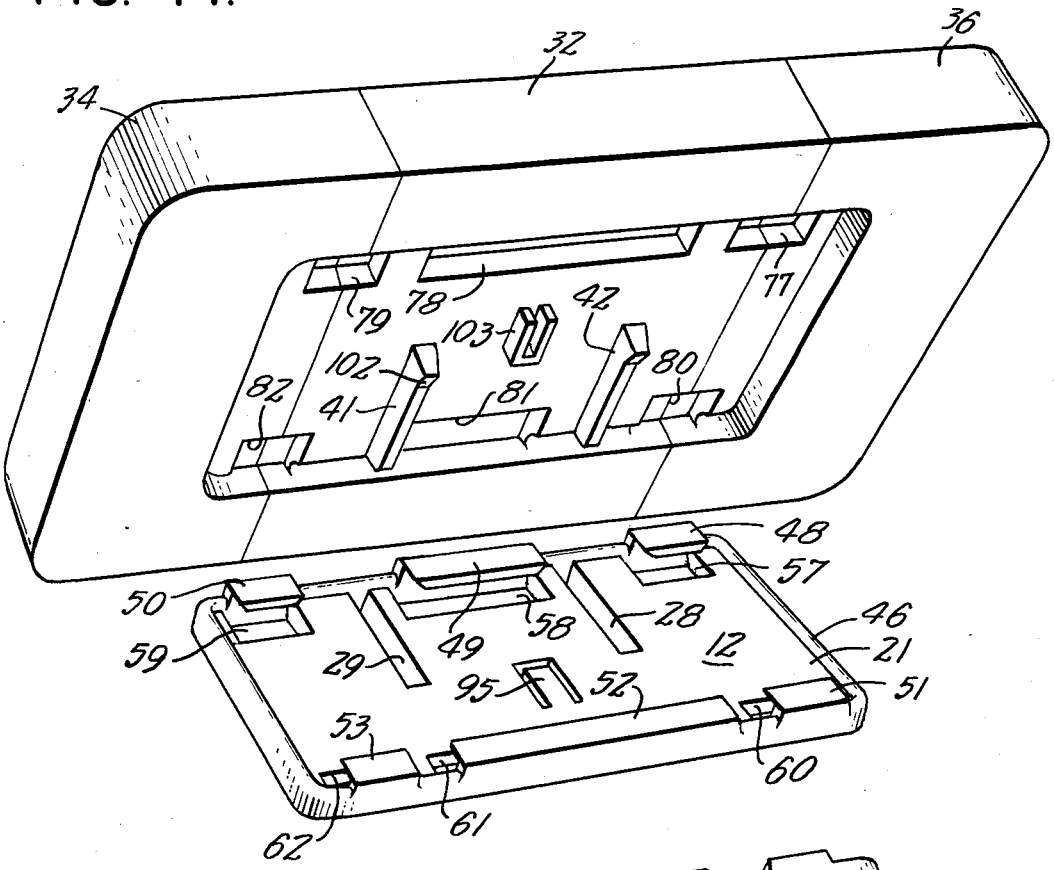
FIG. 14 is a perspective view illustrating an upper mold half, of a mold used in the production of the new label holder of FIG. 3, illustrating a front perspective view of a label holder plate as after removal from the upper mold half.
Figure 15:
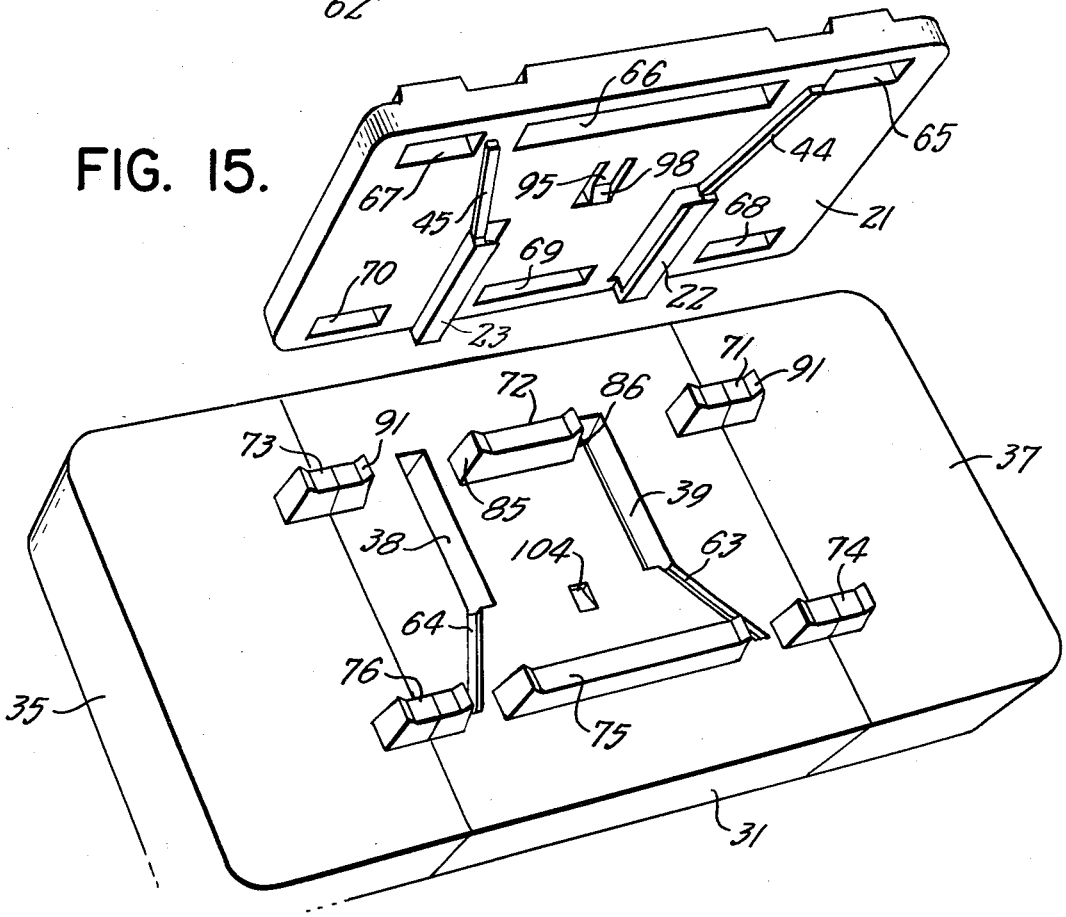
FIG. 15 is a perspective view of a lower mold half, used in conjunction with the mold half of FIG. 14 for the production of the new mold plate, together with a bottom perspective view of a molded label holding plate as after removal from the mold half.

In the production of label holders according to the invention, the individual mold halves, generally as illustrated in FIGS. 14, 15, are assembled in mold carriers 46, such as shown in FIG. 16. The appropriate selection of the end pieces 34, 36 and 35, 37 will allow label holders of various lengths to be produced in conjunction with a common pair of center mold sections 31, 32. In each case, the assembly of mold elements is retained within the same mold carrier 46. Production is carried out using high speed, injection molding techniques, in themselves known in the art and not forming part of the present invention.

Because of the unique design of the label holder of the invention, cooperating back flanges, for the reception of a standardized mounting plate, are formed on the back side of the label holder, while upper and lower label-retaining flanges are formed along the front side of the label holder, along the top and bottom edges. The design of the label holder provides for through openings in the body of the label holder opposite each of these front and back flange sets, such that the mold parts for forming these flanges may project from one side of the label holder through the opposite side, some projecting from the front side and others projecting through from the back side. This enables a rather complex label structure to be formed with a simplified, two-part mold arrangement which is capable of automated, high speed injection molding procedures.

A label holder constructed in accordance with the invention is greatly superior in all functional ways to more conventional label holder constructions utilizing cut-to-length extruded sections. The new label holder can be finished on all surfaces, edges and corners, being dimensioned throughout with great precision and thus of highly uniform, attractive appearance. Importantly, since the label holder is designed to be mounted on the label holding plate on a display hook in a precise manner, an overall display of merchandise, utilizing the label holders of the invention, has a neater and more presentable appearance than has been possible with the more conventional, extruded type label holders. This neater appearance, moreover, is always maintained, because the label holders cannot be shifted relative to the display hook, as is possible with the extruded devices.

In addition to the foregoing, the label holding devices of the invention may be made in clear, transparent plastic materials, such as polystyrene, in formulations that are not practicable for extruded constructions. This too adds importantly to the overall improved appearance of a merchandise display.

Notwithstanding the many important functional advantages of the label holder of the invention, as compared more conventional label holders designed for application to standard mounting plates, the label holders of the invention are fully cost competitive with the conventional devices. Indeed, quite surprisingly, the design of the label holder of the invention is so simplified that it can be manufactured in many cases at a lower cost than more conventional, continuously extruded shapes.

Significant to the invention is the provision of discontinuous upper and lower label retaining flanges that can be effectively formed by mold ribs projecting through the label holder from the back side thereof. The discontinuous flanges are designed to allow end-wise insertion of a label into the label holder, with fully effective label retention. The several through openings in the label holder plate, provided for the accommodation of the mold projections, are effectively concealed by the label itself, as are the through openings in the central portion of the label holder, provided for the formation of the rearwardly projecting, plate engaging flanges 22, 23.

The design of the label holder provides for a great number of advantageous functional features to be realized, yet allows a relatively simplified, two-part mold arrangement to be employed in manufacture. As a result, it is possible to produce the item on a highly automated, injection molding procedure at extremely low per unit cost.

It should be understood, of course, that the specific form of the invention herein illustrated and described is intended to be representative only, as certain changes may be made therein without deparating from the clear teachings of the disclosure. Reference should be made to the following appended claims in determining the full scope of the invention.

We claim:

1. A molded plastic label holder for point-of-purchase merchandise displays and the like, comprising (a) a generally thin, flat plate-like label support formed of molded rigid plastic material and having front and back faces, (b) a first set of integrally molded vertically oriented generally L-shaped flanges projecting rearward from the back face of said plate-like label support, (c) a second set of integrally molded horizontally oriented generally L-shaped flanges projecting forward from the front face of the label support, (d) each of said sets of flanges including outer flange portions spaced from and in opposition to the adjacent face of said label support for the confinement of a thin object therebetween, (e) said label support being formed with through openings therein substantially coextensive in size and shape with said outer flange portions and located directly opposite said outer flange portions, whereby flange portions on one side of said label support are accessible from the opposite side of said label support, (f) one of said sets of L-shaped flanges being comprised of horizontally disposed retaining flange means extending discontinuously along the respective upper and lower edge margins of the front face of said label support for engagement with upper and lower edge margins of a label or the like, (g) the other of said sets of L-shaped flanges comprising a spaced pair of mounting flanges extending vertically along the back face of said label support and engageable with a mounting plate, (h) said horizontally disposed retaining flange means comprising upper and lower sets of aligned flange sections, each constituting a discontinuous flange, along an edge margin of said label support, (i) the flange along said upper margin comprising at least a center flange section and two outer flange sections spaced laterally therefrom, (j) spaced openings being formed in the label support directly opposite the spaced apart flange sections alongs said upper margins, (k) said vertically extending flanges being aligned generally with and projecting into the spaces between said center flange section and said outer flange sections, (l) the discontinuous flange along the lower margin comprising at least a center flange section and two outer flange sections spaced laterally therefrom, (m) said label holder including a pair of downwardly divergent, integral guide ribs extending from said vertically extending flanges, (n) spaced openings being formed in the label support directly opposite the spaced apart flange sections along said lower margins, and (o) the lower ends of said guide ribs being aligned generally with and extending into the spaces between the center and outer sections of the lower flange.

2. A plastic label holder according to claim 1, further characterized by (a) said aligned flange sections being beveled at each end edge to form convergent entrance areas to facilitate the guided endwise insertion of a label or the like between the front face of said label support and the outer portions of said flange sections.

3. The combination of claim 1, further characterized by (a) said label holding plate being formed on its front surface with an integrally molded peripheral bead, and (b) the openings associated with said label holding flanges being located closely adjacent to but within the confines of said peripheral bead.

* * * * *